US005643058A

United States Patent [19]

Erichsen et al.

[11] Patent Number: 5,643,058

[45] Date of Patent: Jul. 1, 1997

[54] ABRASIVE FLUID JET SYSTEM

[75] Inventors: Glenn A. Erichsen, Everett; John C. Massenburg, Seattle; Chip Burnham, Tukwila; Thomas Harry O'Connor, Buckley; Rhonda R. Smith, Seattle; Katherine Zaring; Robert P. Many, both of Kent, all of Wash.

[73] Assignee: Flow International Corporation, Kent, Wash.

[21] Appl. No.: 513,381

[22] Filed: Aug. 11, 1995

[51] Int. Cl.[6] ..... B24B 7/00; B24B 9/00

[52] U.S. Cl. ..... 451/99; 451/100; 451/101; 451/102; 451/60; 451/75; 451/90; 451/446

[58] Field of Search ..... 451/99, 101, 100, 451/102, 66, 75, 446, 90

[56] References Cited

U.S. PATENT DOCUMENTS

| | | | |
|---|---|---|---|
| 2,985,050 | 5/1961 | Schwacha | 83/53 |
| 4,048,757 | 9/1977 | Kubus et al. | 451/99 |
| 4,216,906 | 8/1980 | Olsen et al. | 239/11 |
| 4,313,570 | 2/1982 | Olsen | 239/583 |
| 4,478,368 | 10/1984 | Yie | 239/430 |
| 4,505,077 | 3/1985 | Sheesley et al. | 451/99 |
| 4,555,872 | 12/1985 | Yie | 451/102 |
| 4,648,215 | 3/1987 | Hashish et al. | 51/439 |
| 4,702,042 | 10/1987 | Herrington et al. | 51/321 |
| 4,703,591 | 11/1987 | Herrington et al. | 51/321 |
| 4,707,952 | 11/1987 | Krasnoff | 51/410 |
| 4,709,515 | 12/1987 | Copeland et al. | 451/101 |
| 4,711,056 | 12/1987 | Herrington et al. | 51/410 |
| 4,817,874 | 4/1989 | Jarzebowicz | 239/434 |

(List continued on next page.)

FOREIGN PATENT DOCUMENTS

| | | | |
|---|---|---|---|
| 583076 | 10/1958 | Italy | 451/101 |

*Primary Examiner*—Robert A. Rose
*Assistant Examiner*—George Nguyen
*Attorney, Agent, or Firm*—Seed and Berry LLP

[57] ABSTRACT

An improved system for generating an abrasive fluid jet is shown and described. In a preferred embodiment, abrasive is fed from a bulk hopper into an air isolator having a baffle that limits the flow of air and abrasive through the air isolator, thereby venting air from the abrasive. An on/off device having a rod coupled to a stopper is provided within the air isolator, the rod being selectively raised and lowered in a vertical direction. A discharge orifice is provided in a bottom surface of the air isolator, the stopper covering the discharge orifice when the rod is in a lowered position, thereby preventing the discharge of abrasive from the air isolator.

A metering disk is provided adjacent the discharge orifice, an orifice in the metering disk being aligned with the discharge orifice, such that abrasive exiting the air isolator flows through the metering disk. A vented adapter is coupled to the air isolator, which helps to control the flow of abrasive through the system and serves to eject any abrasive or fluid that may back up into the system due to a clog, thereby preventing fluid from backing up into the air isolator. Abrasive is then fed from the vented adapter through a feedline into a mixing chamber of a cutting head, the abrasive being entrained by a high-pressure fluid jet, such that the abrasive and high-pressure fluid jet mix and are ejected through a mixing tube coupled to the cutting head as an abrasive fluid jet.

The high-pressure fluid jet is generated by forcing a volume of high-pressure fluid through an orifice that is set in a tapered mount, the tapered mount being seated in the cutting head and having shallowly tapered walls, such that the mount does not swage itself into the cutting head. The mixing tube is provided with a reference member on an outer surface of the mixing tube, thereby positioning the mixing tube in a simple and efficient manner.

The cutting head is further provided with a second inlet port that may be coupled to any selected attachment, for example, an assembly for monitoring the performance of the system or a piercing attachment.

37 Claims, 5 Drawing Sheets

U.S. PATENT DOCUMENTS

| | | | |
|---|---|---|---|
| 4,829,724 | 5/1989 | Miller, Jr. et al. | 451/101 |
| 4,934,111 | 6/1990 | Hashish et al. | 51/410 |
| 4,936,059 | 6/1990 | Hashish et al. | 51/439 |
| 4,951,429 | 8/1990 | Hashish et al. | 451/102 |
| 4,955,164 | 9/1990 | Hashish et al. | 51/321 |
| 5,018,670 | 5/1991 | Chalmers | 239/433 |
| 5,054,249 | 10/1991 | Rankin | 451/101 |
| 5,092,085 | 3/1992 | Hashish et al. | 51/439 |
| 5,144,766 | 9/1992 | Hashish et al. | 51/439 |
| 5,155,946 | 10/1992 | Domann | 451/102 |
| 5,232,155 | 8/1993 | Chen | 451/102 |
| 5,320,289 | 6/1994 | Hashish et al. | 239/434 |
| 5,505,653 | 4/1996 | Nedo et al. | 451/99 |

ABRASIVE FLUID JET SYSTEM

TECHNICAL FIELD

This invention relates to high-pressure fluid jets, and more particularly, to an improved system for generating a high-pressure abrasive fluid jet.

BACKGROUND OF THE INVENTION

The cutting of numerous types of materials, for example, glass, metal, or ceramics, may be accomplished through use of a high-pressure abrasive fluid jet that is generated by mixing abrasive particles, for example, garnet, with a high-pressure fluid jet. Although different fluids may be used, high-pressure fluid jets are typically water, and are generated by high-pressure, positive displacement pumps that can pressurize water to 2,000–75,000 psi.

Currently available systems for generating abrasive fluid jets are adequate, but have some disadvantages. For example, abrasive is fed to the system from a bulk hopper to a secondary hopper that has a metering device mounted in its base. Typically, the secondary hopper is filled by a feed tube in a self-regulating fashion, in which the abrasive will rise to some level in the hopper and then stop. The secondary hopper, although smaller than the bulk hopper, typically has a diameter on the order of 6–8 inches and a length of 15–20 inches, which can be cumbersome, given that it is typically desirable to mount the secondary hopper on motion equipment.

Furthermore, currently available systems do not always have a controlled or consistent feed rate of abrasive, which contributes significantly to the cost of operation. Also, manufacturing is somewhat cumbersome.

Applicants therefore believe that an improved system for generating abrasive fluid jets is possible, and desirable, both from a manufacturing and performance viewpoint.

SUMMARY OF THE INVENTION

It is therefore an object of this invention to provide an abrasive fluid jet system that is more efficient and convenient to use.

It is another object of this invention to provide an abrasive fluid jet system that is more simple and cost effective to manufacture and use.

These and other objects of the invention, as will be apparent herein, are accomplished by providing an improved abrasive fluid jet system. In a preferred embodiment, abrasive is fed from a bulk hopper by compressed air at low velocities to an air isolator containing a baffle that restricts the flow of air and abrasive through the air isolator. An opening is provided in the baffle through which abrasive may drop, the baffle thereby acting to vent air from the abrasive. As a result, the flow rate of abrasive through the system is independent of the air pressure pushing the abrasive, thereby making the flow rate consistent and the system more reliable. Through use of a baffle and vents provided in a top region of the air isolator, the air isolator may be 5–10 times smaller than a conventional secondary hopper which is replaced by the air isolator.

In a preferred embodiment, an "on/off" device for the system is located within the air isolator, the on/off device having a rod that passes through the opening in the baffle, and that has a stopper on one end. The rod is selectively raised and lowered in a vertical direction, by an air cylinder. A discharge port is provided in a bottom surface of the air isolator, and when the rod is in a raised position, abrasive is allowed to flow out of the air isolator through the discharge port. However, when the rod is in a lowered position, corresponding to an operator of the system turning the tool in use off, the stopper covers the discharge port, such that abrasive is prevented from discharging from the air isolator. Directly adjacent the discharge orifice is a metering disk having an opening that is aligned with the discharge orifice, a gap between the metering disk and the bottom surface of the air isolator preferably being less than 1/16 of an inch.

Abrasive passing through the metering disk passes through a vented adapter that is coupled to the air isolator with a locking mechanism that can be selectively engaged or disengaged with a simple quarter mm of the vented adapter. In a preferred embodiment, the vented adapter is provided with a first port that intersects a second port at an angle, the second port having a vent through which abrasive and fluid may be ejected from the system if a clog downstream causes fluid and abrasive to back up. A second vent is provided in the adapter to ensure that the flow rate of abrasive into the adapter is due to gravity and that the abrasive is not pulled through the metering disk by the high-pressure fluid jet into which the abrasive is mixed.

In a preferred embodiment, the high-pressure fluid jet is generated by forcing a volume of high-pressure fluid, typically water, through a nozzle body and through a high-pressure orifice. The orifice is set into a tapered mount assembly, which in turn is seated in the cutting head. The high-pressure orifice is recessed in a top surface of the mount assembly to prevent the orifice from being damaged, for example, by being touched by an operator that will likely have abrasive on his or her hands. The sidewalls of the mount assembly are shallowly tapered, such that only the top surface of the mount assembly seals the high-pressure fluid, and the mount assembly does not swage itself into the cutting head. As a result, even after continued running at ultra-high pressures such as 55,000 psi, the mount drops out easily from the cutting head and does not require special tools to be removed, as is typically required with conventional taper mount systems.

The high-pressure fluid jet emitted by the high-pressure orifice enters a mixing chamber wherein it entrains abrasive through an abrasive inlet port provided in the cutting head. The abrasive and high-pressure fluid jet are then mixed and ejected as an abrasive fluid jet through a mixing tube that is provided in the cutting head. In a preferred embodiment, the cutting head is provided with a simple bore into which the mixing tube is inserted. A reference member is provided at a selected location on an outer surface of the mixing tube, such that the reference member registers against a bottom surface of the cutting head, thereby positioning the mixing tube at a desired location. The mixing tube is then held in place by a retention device such as a nut.

The cutting head is provided with a second inlet port, such that the feedline and abrasive feed apparatus may be coupled to either the first port or the second port of the cutting head, as may be preferred given the operating conditions. The second, unused port may then be either simply blocked off, or may be coupled to any selected apparatus, for example, a piercing attachment or a device for monitoring the performance of the system.

DETAILED DESCRIPTION OF THE INVENTION

Figure 1:
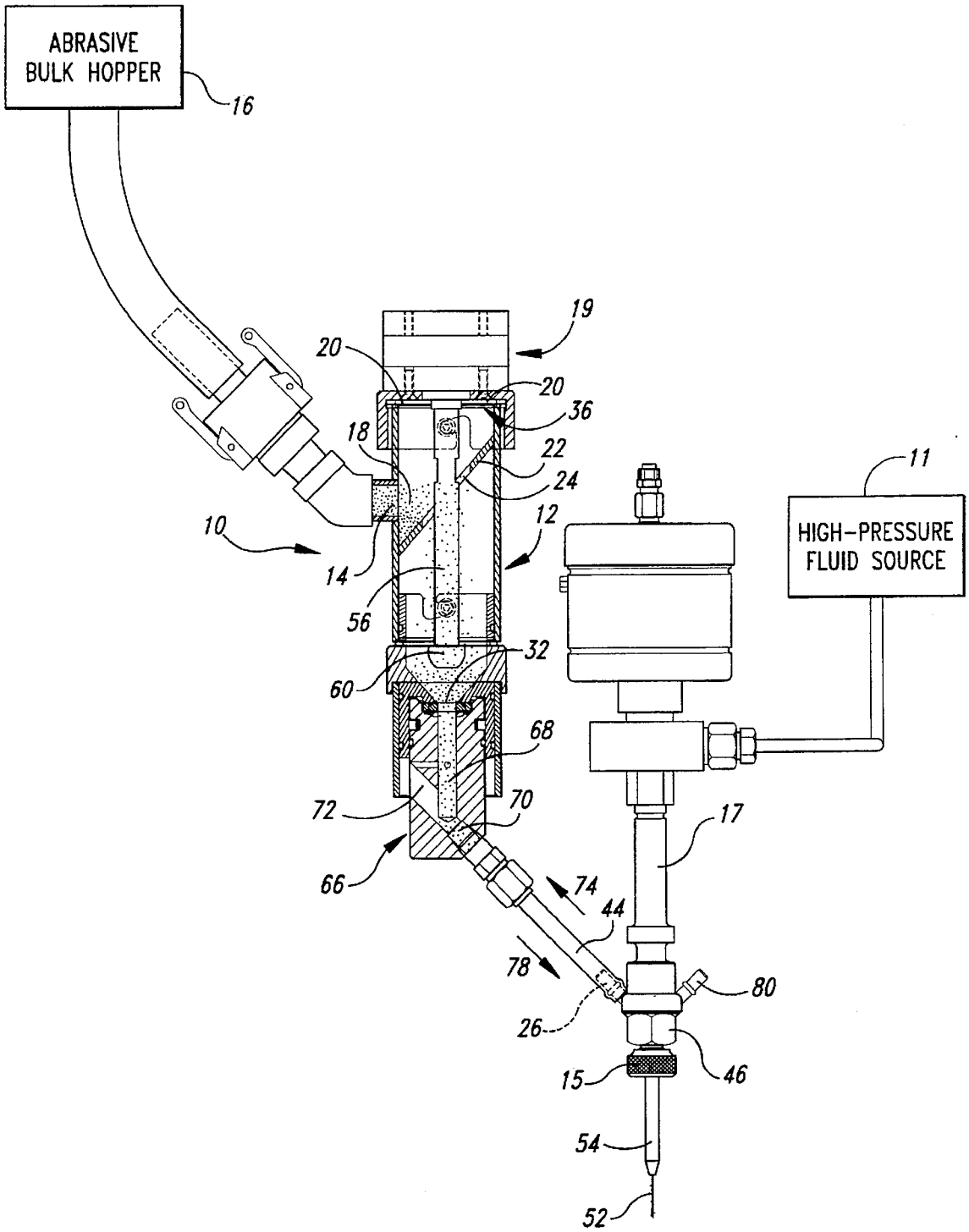
FIG. 1 is a partial cross-sectional, elevational view of a preferred embodiment of the present invention.
Figure 2:
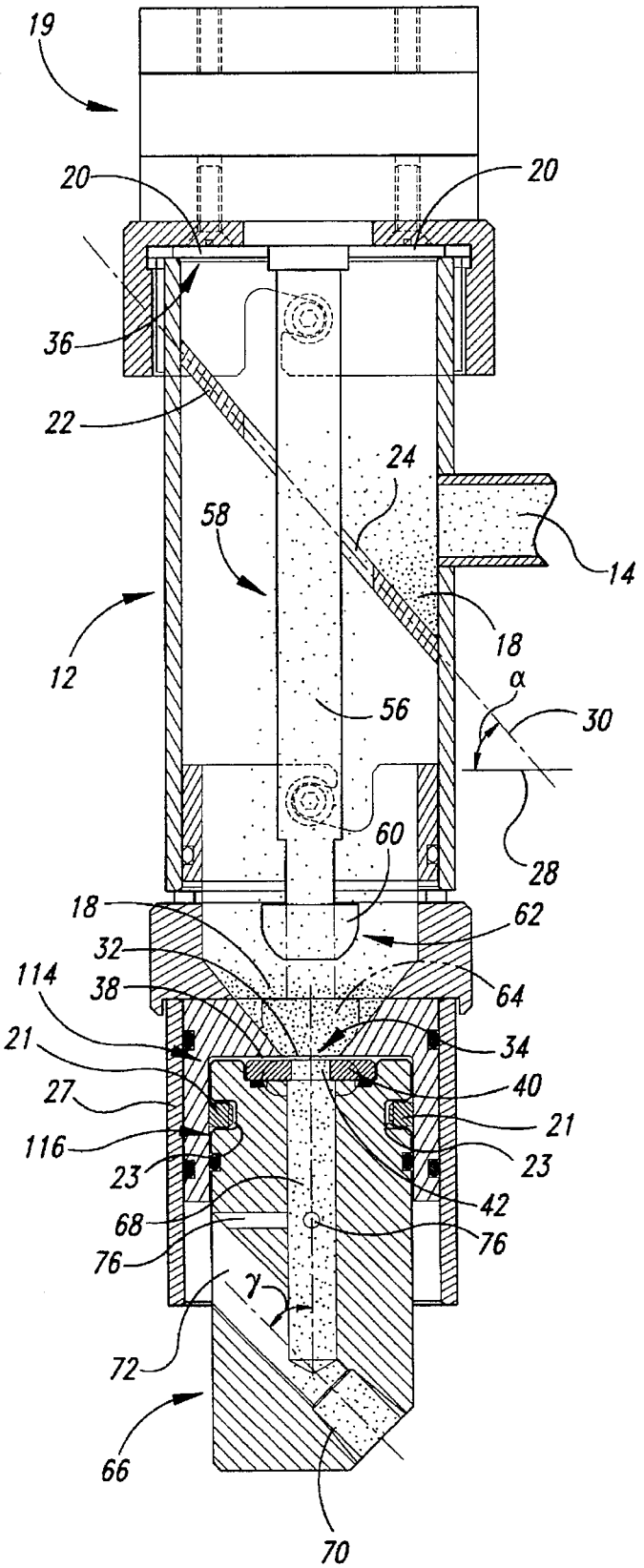
FIG. 2 is an enlarged cross-sectional, elevational view of several elements of the preferred embodiment illustrated in FIG. 1.

An improved abrasive fluid jet system 10, provided in accordance with a preferred embodiment of the present invention, is illustrated in FIG. 1. A volume of abrasive particles 18 is fed from abrasive bulk hopper 16 by compressed air at low velocities into air isolator 12 via inlet port 14. Although different types of abrasive may be used, a preferred embodiment uses garnet particles, on the order of 16–220 mesh. A baffle 22 is provided within the air isolator 12, the baffle having a hole 24 through which abrasive may fall. In a preferred embodiment, as illustrated in FIG. 2, an angle $\alpha$ of the baffle, as measured between the baffle 22 and a horizontal plane 28 intersecting the lower-most edge 30 of the baffle, is 20°–60°, with preferred results being achieved when the baffle is 41°. It will be understood that the angle of the baffle may be changed to accommodate various vessel geometries. By providing an air isolator 12 having a baffle 22, air is vented from the abrasive as it passes through the baffle. The venting is further enhanced by providing vents 20 in a top region 36 of the air isolator 12. The venting of air from the abrasive ensures that the flow rate of abrasive through the system is independent of the pressure of the air pushing the abrasive from the bulk hopper. This improved consistency in abrasive feed rate is significant, in that it substantially reduces operating costs. Furthermore, by venting air from the abrasive in this manner, the air isolator 12 may be lightweight and 5–10 times smaller than its conventional counterpart, making the system more efficient and simple to use, particularly if it is necessary to mount the air isolator on equipment that moves during operation of the system. In a preferred embodiment, the air isolator has an outer diameter of 2.38 inches, an inner diameter of 2 inches and a length of approximately 6 inches.

A discharge orifice or port 32 is provided in a bottom surface 34 of air isolator 12, the discharge orifice being selectively open or closed via operation of on/off device 58, as seen in FIG. 2. In a preferred embodiment, the on/off device 58 comprises a rod 56 that passes through the hole 24 of baffle 22, the rod 56 being selectively raised to a first position 62 and lowered to a second position 64 via pneumatic cylinder 19. Rod 56 is coupled to a stopper 60 which covers the discharge orifice 32 when the rod is in a lowered position 64, thereby preventing the discharge of abrasive from air isolator 12. The rod and stopper are made of wear-resistant materials, and are only required to move short distances, thereby ensuring reliable performance and longevity. In a preferred embodiment, the on/off device 58 is controlled by the operator via conventional means, for example, a solenoid switch. By providing the on/off device 58 within air isolator 12, the system is simplified and made more compact, as compared to conventional systems where the on/off device is typically external to the hopper feed system.

As best seen in FIG. 2, a metering disk 40 having an orifice 42 is provided adjacent the bottom surface 34 of the air isolator 12, the orifice 42 of the metering disk being aligned with the discharge orifice 32. The size of the metering disk orifice controls the flow rate of abrasive through the system, and it may therefore be selected and changed, depending on the desired flow rate. In a preferred embodiment, a gap 38 between the metering disk 40 and bottom of the air isolator 12 is less than 1/16 of an inch, to ensure that abrasive backs up in the bottom of the air isolator. If the gap 38 is too large, the stream of abrasive may neck down, thereby pouring through the metering disk orifice in a stream that is smaller than the orifice, such that the metering disk fails to provide its desired function. Also, by providing a system in accordance with a preferred embodiment of the present invention, the abrasive flow may be stopped and started quickly and efficiently.

As further illustrated in FIGS. 1 and 2, abrasive passing through the metering disk 40 enters a first port 68 of an adapter 66, which is further provided with a second port 70. In a preferred embodiment, the first port 68 and second port 70 are provided at an angle $\gamma$ to each other of 30°–60°, with preferred results being obtained when $\gamma$ is 45°. The second port 70 is provided with a vent 72 through which fluid and abrasive may be ejected from the system, for example, if a clog downstream 78 of the adapter 66 causes fluid and abrasive to flow in an upstream direction 74. As a result, water is prevented from backing up into the air isolator, such that the abrasive does not clump together, and continues to flow freely. Adapter 66 is further provided with one or more secondary vents 76 that allow air to enter the first port 68, thereby ensuring that the flow rate of abrasive through the metering disk and through the first port 68 is due to gravity, and is substantially independent of suction in the feedline 44. (It will be understood that the abrasive flow rate is typically measured in pounds/minute). To further shield the system from water spray, a protective shield 27 is provided around adapter 66.

As illustrated in FIG. 2, a bottom region 114 of air isolator 12 and a top region 116 of adapter 66 selectively and easily engage and disengage each other to facilitate cleaning. Although any conventional locking mechanism may be used, in a preferred embodiment, three pins 21 are engaged and locked into recesses 23 when the air isolator and adapter are turned a quarter turn relative to each other. It should also be noted that due to the small size of the air isolator 12, only 1–2 pounds of abrasive must be dumped when cleaning the system, as opposed to 5–300 pounds in conventional systems.

Figure 3B:
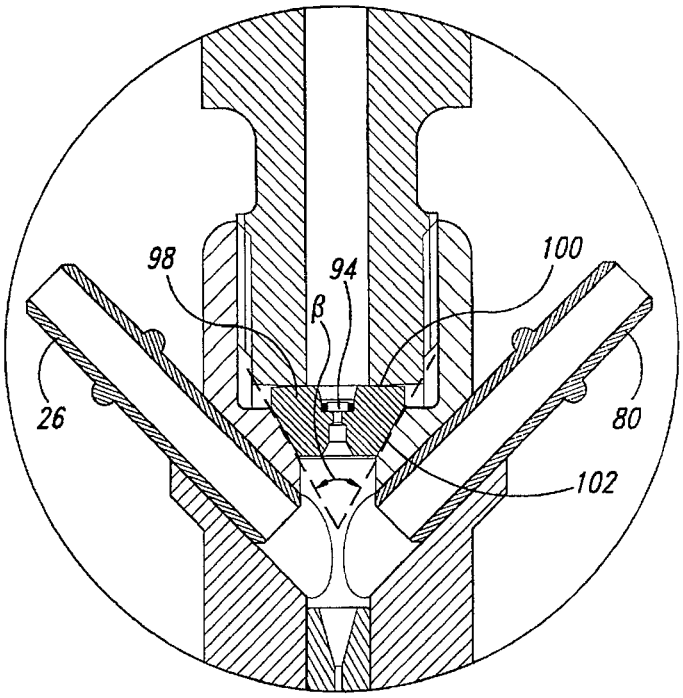
FIGS. 3A and 3B are cross-sectional, elevational views of a portion of the preferred embodiment illustrated in FIG. 1.
Figure 3A:
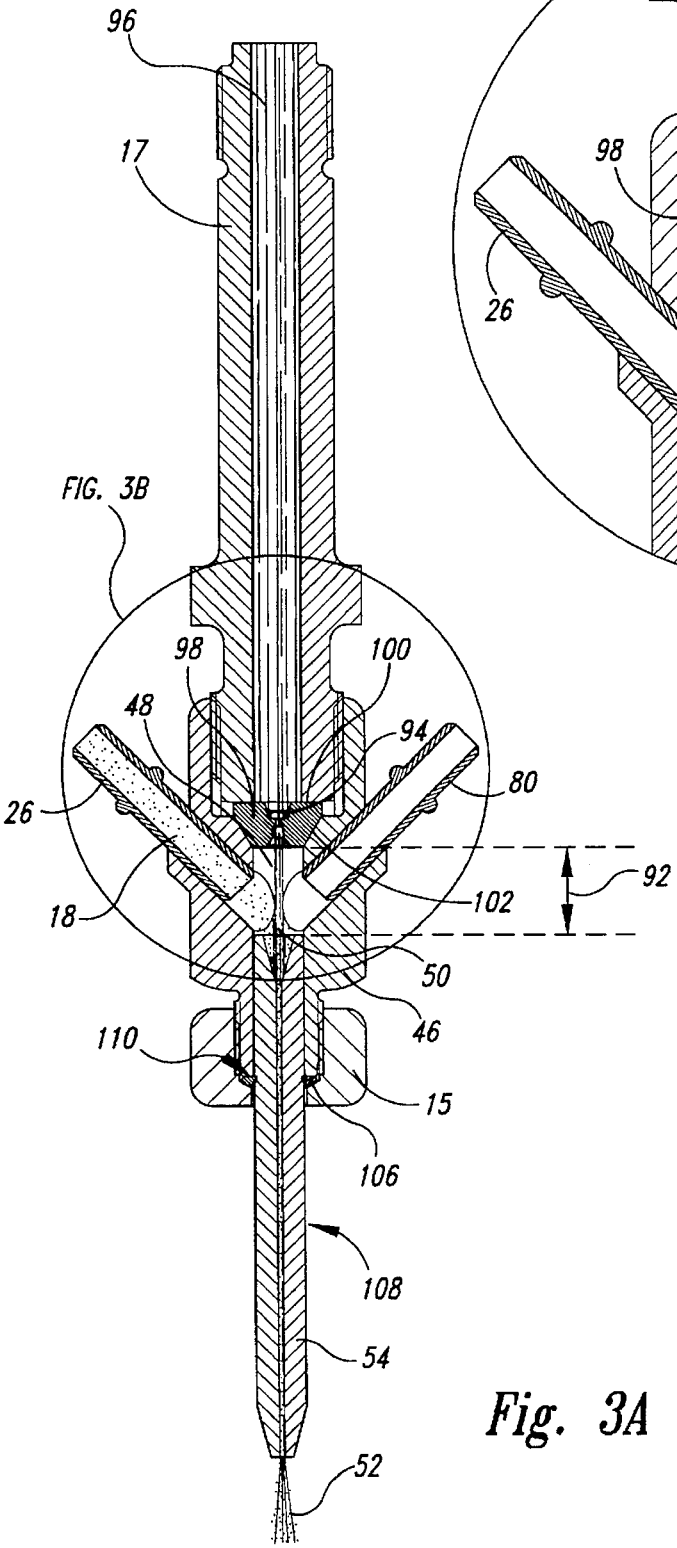

After passing through adapter 66, abrasive 18 flows through feedline 44 that is coupled to a cutting head 46. More particularly, as best seen in FIG. 3A, abrasive is gravity fed through the first port 68 as described above, and then is drawn through the second port 70, the feedline 44 and a first inlet 26 into mixing chamber 48, by a vacuum generated by a high-pressure fluid jet 50. The high-pressure fluid jet 50 thereby entrains the abrasive such that the fluid jet and abrasive are mixed and ejected through mixing tube 54 as an abrasive fluid jet 52.

The high-pressure fluid jet 50 is generated by forcing a volume of high-pressure fluid 96, for example, water, from a high-pressure fluid source 11 through nozzle body 17 and a high-pressure orifice 94. The high pressure orifice 94 is set in a tapered mount 98, and is recessed in a top surface 100 of the tapered mount to reduce the likelihood that the orifice will be touched, for example, by an operator's hand which may have abrasive on it. The orifice is therefore less likely to be damaged. As best seen in FIG. 3B, an angle $\beta$ of the circumferentially tapered side surface 102 of the mount is preferably 55°–80°, with preferred results being obtained when the included angle is 60°. By providing a shallow taper, the mount 98 does not swage itself into the cutting head. The mount may therefore be easily removed without the use of a tool, even after continuous running at ultra-high pressures, as is typically required in conventional systems. Also, top surface 100 is slightly tapered such that the high pressure fluid is sealed by top surface 100 only, not by side surface 102.

The mixing tube 54 is provided with a reference member 106 on an outer surface 108 of the mixing tube. In a preferred embodiment, a metal ring is adhered to the outer surface of the mixing tube. The cutting head 46 is provided with a bottom surface 110 and a bore extending upward from the bottom surface, into which the mixing tube is inserted. By providing a reference member 106 at a desired location on the outer surface of the mixing tube, the reference member registers against the bottom surface 110 of the cutting head, thereby preventing the mixing tube from being inserted any further into the bore 112, thereby positioning the mixing tube in a desired location. The mixing tube 54 is further held in place via retention nut 15. By positioning the mixing tube 54 in accordance with the preferred embodiment of the present invention, manufacturing is simplified as compared to conventional systems wherein the means for registering the mixing tube are located internally in the cutting head.

The length 92 of mixing chamber 48 is minimized and optimized, thereby reducing wear in the mixing chamber 48, such that the need for a protective, and typically expensive, carbide shield is eliminated. It is believed that by minimizing the length of the mixing chamber, the high-pressure fluid jet 50 remains more coherent as it flows through the mixing chamber to the mixing tube 54, and that this reduction in turbulence results in less wear in the mixing chamber. Although it will be understood that the length of the mixing chamber will be dependent on different variables, for example the size of the orifice, and the angle at which the inlets 26 and 80 are provided in the cutting head 46, in a preferred embodiment wherein the mount accommodates orifices ranging in size from 0.003–0.02 inch, the length of the mixing chamber is 0.4–0.75 inch.

In a preferred embodiment, the cutting head 46 is provided with a second inlet 80, such that the feedline may be coupled to either the first inlet 26 or second inlet 80, as may be desirable given operating conditions. If, for purposes of illustration, the feedline is coupled to the first inlet 26, the second inlet 80 may simply be closed off or it may be coupled to any selected attachment, for example, an assembly for monitoring the performance of the system, a piercing attachment, or another abrasive feedline.

Figure 4:
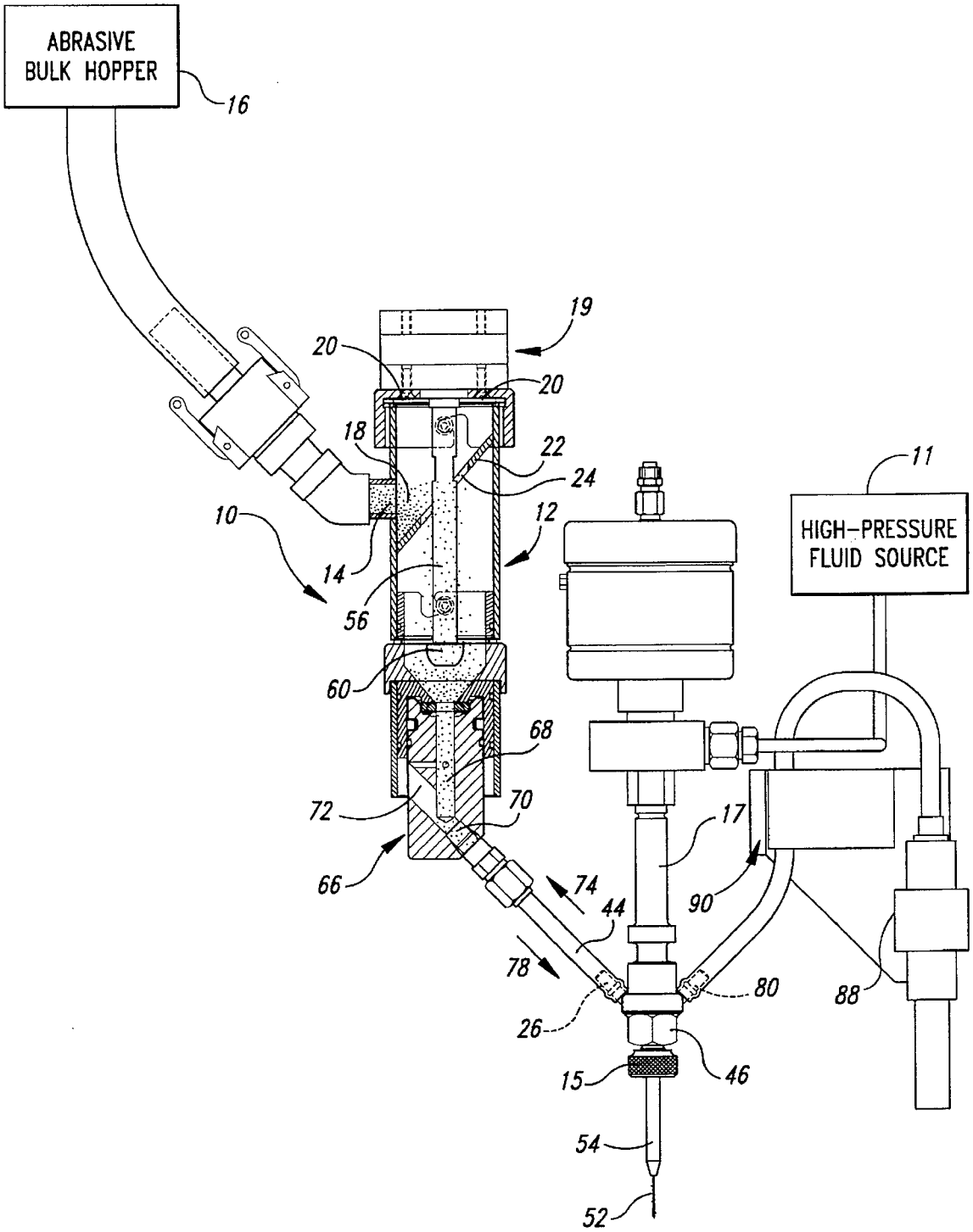
FIG. 4 is a partial cross-sectional, elevational view of an alternative embodiment of the present invention.

For example, as illustrated in FIG. 4, a piercing attachment comprising an air eductor 88 and a pinch valve 90, is coupled to the second inlet 80. When starting a cut in a material where the cutting head is not at an edge of the material, it is desirable to first pierce the material, to ensure that the material is not damaged. (Brittle materials, for example glass, ceramic or stone, may be damaged by conventional start up techniques where abrasive is not present in the high-pressure fluid stream when the stream initially contacts the material. Similarly, such conventional start up techniques may de-laminate some materials such as composites.) To achieve this desired result, it is necessary to ensure that abrasive is present in the fluid jet when it first contacts the material. This is accomplished, in a preferred embodiment of the present invention, by opening a valve 90 and activating air eductor 88, such that abrasive is drawn into the mixing chamber prior to generating the high-pressure fluid jet 50. By maintaining a length of feedline 44 at no more than 12 inches, and by ensuring that metering disk 40 is elevated above mixing chamber 48, the vacuum required to draw abrasive into the mixing chamber is minimized, thereby simplifying the system.

Figure 5:
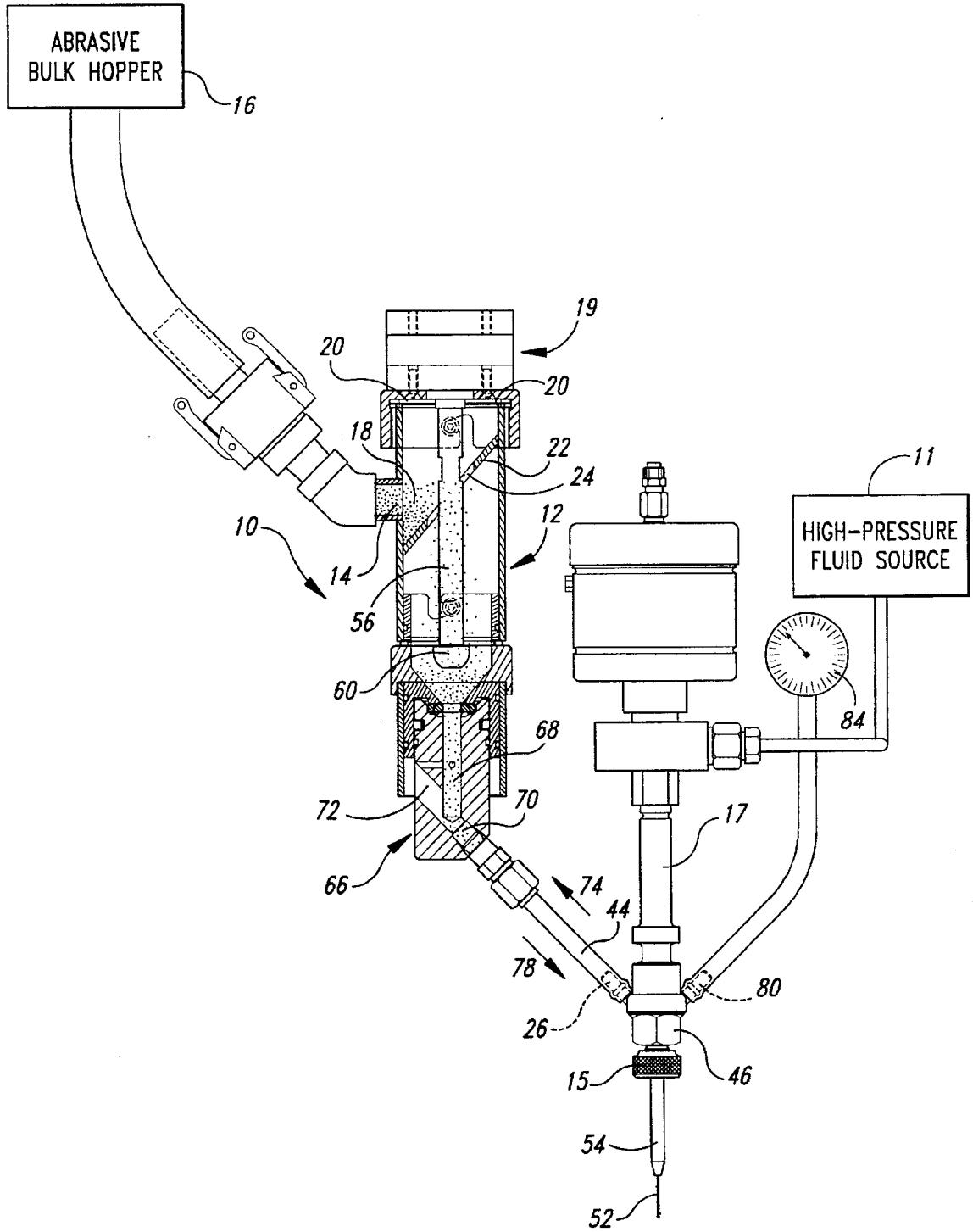
FIG. 5 is a partial cross-sectional, elevational view of an alternative embodiment of the present invention.

In an alternative embodiment, as illustrated in FIG. 5, a vacuum gauge 84 is coupled to the second inlet 80 of cutting head 46 for monitoring the performance of the system.

An improved abrasive fluid jet system has been shown and described. From the foregoing, it will be appreciated that, although embodiments of the invention have been described herein for purposes of illustration, various modifications may be made without deviating from the spirit of the invention. Thus, the present invention is not limited to the embodiments described herein, but rather is defined by the claims which follow.

We claim:

1. An abrasive fluid jet system comprising:

an air isolator having a port through which a volume of abrasive is introduced into the air isolator;

a baffle positioned within the air isolator to restrict the flow of air and abrasive through the air isolator, the baffle having an opening through which the abrasive may pass;

a discharge orifice being provided in a surface of the air isolator downstream of the opening in the baffle through which abrasive may exit the air isolator, the discharge orifice being selectively open or closed;

a metering disk adjacent the discharge orifice such that an orifice in the metering disk is aligned with the discharge orifice and abrasive may flow through the metering disk; and a feedline coupled to the metering disk and to a cutting head, the cutting head having a mixing chamber into which the abrasive from the air isolator and a high-pressure fluid jet are introduced, the abrasive and the high-pressure fluid jet being mixed and discharged as an abrasive fluid jet through a mixing tube coupled to the cutting head.

2. The abrasive fluid jet system according to claim 1 wherein a top region of the air isolator is provided with a vent.

3. The abrasive fluid jet system according to claim 1 wherein the baffle is positioned at an angle of 20°–60° relative to a horizontal plane that intersects a lowermost edge of the baffle.

4. The abrasive fluid jet system according to claim 1 wherein a gap between the metering disk and the air isolator is no greater than 1/16".

5. The abrasive fluid jet system according to claim 1 further comprising:

a rod extending through the opening in the baffle and having a stopper adjacent the discharge orifice, the rod being selectively raised and lowered in a vertical direction, the stopper covering the discharge orifice when the rod is lowered, thereby preventing abrasive from flowing through the discharge orifice.

6. The abrasive fluid jet system according to claim 1, further comprising:

an adapter provided between the metering disk and the feedline, the adapter having a first port and second port provided at an angle relative to each other of 30°–60°, such that abrasive flowing from the air isolator passes through the first port, turns substantially 30°–60°, and flows through the second port to the feedline, a first vent being provided in the adapter to discharge from the system any fluid or abrasive that may flow upstream as a result of a clog occurring downstream.

7. The abrasive fluid jet system according to claim 6 wherein the adapter is further provided with a second vent that allows air to flow into the first port, thereby ensuring that the flow rate of abrasive to the cutting head is substantially independent of any suction in the feedline.

8. The abrasive fluid jet system according to claim 6 wherein the adapter is made of a translucent material such that an operator may view the abrasive as it flows through the adapter.

9. The abrasive fluid jet system according to claim 6 wherein a bottom region of the air isolator and a top region of the adapter selectively engage and disengage each other such that the adapter and air isolator may be easily attached to or detached from each other.

10. The abrasive fluid jet system according to claim 1 wherein the cutting head is provided with a first inlet and a second inlet, such that the feedline may be coupled to either the first inlet or the second inlet.

11. The abrasive fluid jet system according to claim 10 wherein the first inlet is coupled to the feedline and the second inlet is coupled to a selected attachment.

12. The abrasive fluid jet system according to claim 10 wherein the first inlet is coupled to the feedline and the second inlet is coupled to a device for monitoring the performance of the system.

13. The abrasive fluid jet system according to claim 10 wherein the first inlet is coupled to the feedline and the second inlet is coupled to an air eductor and a valve, such that when the valve is opened and the air eductor is activated, abrasive is drawn into the mixing chamber via the first inlet.

14. The abrasive fluid jet system according to claim 13 wherein the feedline is no more than 12 inches long and the metering disk is elevated above the cutting head, thereby minimizing the vacuum that must be generated by the air eductor to draw abrasive into the cutting head.

15. The abrasive fluid jet system according to claim 1 wherein the length of the mixing chamber is 0.4–0.75 inch.

16. The abrasive fluid jet system according to claim 1, further comprising:

a high-pressure orifice through which high-pressure fluid flows to generate a high-pressure fluid jet, the high-pressure orifice being set in a tapered mount that is seated in the cutting head, the tapered mount having a circumferentially tapered side surface, the angle of the taper forming an included angle of 55°–80° such that the mount does not swage itself into the cutting head.

17. The abrasive fluid jet system according to claim 16 wherein the high-pressure orifice is recessed below the top surface of the tapered mount.

18. The abrasive fluid jet system according to claim 1 wherein the mixing tube is provided with a reference member at a selected location on an outer surface of the mixing tube, and the cutting head is provided with a bottom surface and with a bore extending upwards from the bottom surface, the mixing tube being inserted into the bore of the cutting head such that the reference member contacts the bottom surface and prevents the mixing tube from being inserted any further into the bore, thereby locating the mixing tube in a desired location.

19. The abrasive fluid jet system according to claim 18 wherein the reference member is a ring coupled to the outer surface of the mixing tube.

20. An abrasive fluid jet system comprising:

a cutting head having an abrasive inlet port coupled to a source of abrasive and a mixing chamber into which a volume of abrasive and a high-pressure fluid jet are introduced;

a high-pressure orifice contained within a mount assembly that is seated in the cutting head, a volume of high-pressure fluid being forced through the high-pressure orifice to form the high-pressure fluid jet; and a mixing tube coupled to the mixing chamber, the abrasive and the high-pressure fluid jet being mixed and discharged through the mixing tube as an abrasive fluid jet, and wherein the mixing tube is provided with a reference member at a selected location on an outer surface of the mixing tube and the cutting head is provided with a bottom surface and with a bore extending upwards from the bottom surface, the mixing tube being inserted into the bore of the cutting head, such that the reference member contacts the bottom surface and prevents the mixing tube from being inserted any further into the bore, thereby locating the mixing tube in a desired location.

21. The abrasive fluid jet system according to claim 20 wherein the reference member is a ring coupled to the outer surface of the mixing tube.

22. An abrasive fluid jet system comprising:

a cutting head having an abrasive inlet port coupled to a source of abrasive and having a mixing chamber into which a volume of abrasive and a high-pressure fluid jet are introduced;

a high-pressure orifice contained within a mount assembly that is seated in the cutting head, a volume of high-pressure fluid being forced through the high-pressure orifice to form the high-pressure fluid jet, the mount being tapered and having an included angle of 55°–80° such that only a top surface of the mount seals the high-pressure fluid and the mount does not swage itself into the cutting head; and a mixing tube coupled to the mixing chamber, the abrasive and the high-pressure fluid being mixed and discharged through the mixing tube as an abrasive fluid jet.

23. An abrasive fluid jet system according to claim 22 wherein the mixing tube is provided with a reference member at a selected location on an outer surface of the mixing tube and the cutting head is provided with a bottom surface and with a bore extending upwards from the bottom surface, the mixing tube being inserted into the bore of the cutting head, such that the reference member contacts the bottom surface and prevents the mixing tube from being inserted any further into the bore, thereby locating the mixing tube in a desired location.

24. The abrasive fluid jet system according to claim 22 wherein the orifice is recessed below the top surface of the mount.

25. An abrasive fluid jet system comprising:

an air isolator having a port through which a volume of abrasive is introduced into the air isolator;

a baffle positioned within the air isolator to restrict the flow of air and abrasive through the air isolator, the baffle having an opening through which the abrasive may pass;

a discharge orifice being provided in a surface of the air isolator downstream of the opening in the baffle through which abrasive may exit the air isolator; and a feedline coupled to the discharge orifice and to a cutting head, the cutting head having a mixing chamber into which the abrasive from the air isolator and a high-pressure fluid jet are introduced, the abrasive and the high-pressure fluid jet being mixed and discharged as an abrasive fluid jet through a mixing tube coupled to the cutting head.

26. The abrasive fluid jet system according to claim 25 wherein the baffle is positioned at an angle of 20°–60° relative to a horizontal plane that intersects a lowermost edge of the baffle.

27. The abrasive fluid jet system according to claim 25, further comprising:

a rod extending through the opening in the baffle and having a stopper adjacent the discharge orifice, the rod being selectively raised and lowered in a vertical direction, the stopper covering the discharge orifice when the rod is lowered, thereby preventing abrasive from flowing through the discharge orifice.

28. An abrasive fluid jet system comprising:

an air isolator having a port through which a volume of abrasive is introduced into the air isolator;

a discharge orifice being provided in a surface of the air isolator through which abrasive may exit the air isolator; and a feedline coupled to the discharge orifice and to a first inlet of a cutting head, the cutting head having a mixing chamber into which the abrasive from the air isolator and a high-pressure fluid jet are introduced, the abrasive and the high-pressure fluid jet being mixed and discharged as an abrasive fluid jet through a mixing tube coupled to the cutting head, the cutting head having a second inlet that is coupled to an air eductor and a valve, such that when the valve is opened and the air eductor is activated, abrasive is drawn into the mixing chamber via the first inlet, and wherein the feedline is no more than 12 inches long and the metering disk is elevated above the cutting head, thereby minimizing the vacuum that must be generated by the air eductor to draw abrasive into the cutting head.

29. An abrasive fluid jet system comprising:

an air isolator having a port through which a volume of abrasive is introduced into the air isolator;

a discharge orifice being provided in a surface of the air isolator through which abrasive may exit the air isolator;

an adapter coupled to the discharge orifice, the adapter having a first port and second port provided at an angle relative to each other of 30°–60°, such that abrasive flowing from the air isolator passes through the first port, turns substantially 30°–60°, and flows through the second port to the feedline, a first vent being provided in the adapter to discharge from the system any fluid or abrasive that may flow upstream as a result of a clog occurring downstream; and a feedline coupled to the adapter and to a cutting head, the cutting head having a mixing chamber into which the abrasive from the air isolator and a high-pressure fluid jet are introduced, the abrasive and the high-pressure fluid jet being mixed and discharged as an abrasive fluid jet through a mixing tube coupled to the cutting head.

30. The abrasive fluid jet system according to claim 29 wherein the adapter is further provided with a second vent that allows air to flow into the first port, thereby ensuring that the flow rate of abrasive to the cutting head is substantially independent of any suction in the feedline.

31. An abrasive feed device for use in an abrasive fluid jet system comprising:

an air isolator having a port through which a volume of abrasive is introduced into the air isolator;

a baffle positioned within the air isolator to restrict the flow of air and abrasive through the air isolator, the baffle having an opening through which the abrasive may pass; and a discharge orifice being provided in a surface of the air isolator downstream of the opening in the baffle through which the abrasive may exit the air isolator.

32. The abrasive feed device according to claim 31 wherein the baffle is positioned at an angle of 20°–60° relative to a horizontal plane that intersects a lower most edge of the baffle.

33. The abrasive feed device according to claim 31 further comprising:

an on-off device positioned within the air isolator, the on-off device having a rod coupled to a stopper, the rod being selectively moved between a first position and a second position, the stopper covering the discharge port when the rod is in the second position, thereby preventing abrasive from exiting the air isolator.

34. A vented adapter for use in an abrasive fluid jet system comprising:

an adapter body provided with a first port that may be coupled to a source of abrasive and a second port that may be coupled to a feedline, the first port and the second port being provided at an angle relative to each other of 30°–60°, such that abrasive flowing through the first port turns substantially 30°–60°, and flows through the second port, a first vent being provided in the adapter body to discharge any abrasive that may flow upstream from the feedline into the second port.

35. The adapter according to claim 34 wherein the adapter body is further provided with a second vent that allows air to flow into the first port, thereby ensuring that the flow rate of abrasive through the adapter body is substantially independent of any suction in the feedline.

36. A mixing tube for use in an abrasive fluid jet system comprising:

a mixing tube body having a reference member provided at a selected location on an outer surface of the mixing tube body, such that when the mixing tube body is placed into a bore of a cutting head, the reference member contacts a bottom surface of the cutting head and prevents the mixing tube body from being inserted any further into the bore, thereby locating the mixing tube body in a desired location.

37. The mixing tube according to claim 36 wherein the reference member is a ring coupled to the outer surface of the mixing tube body.

* * * * *